United States Patent [19]

Bowler et al.

[11] 4,122,811

[45] Oct. 31, 1978

[54] DIGITAL CLOSED LOOP FUEL CONTROL SYSTEM

[75] Inventors: Lauren L. Bowler, Bloomfield Hills; John O. Rice, Utica, both of Mich.

[73] Assignee: General Motors Corporation, Detroit, Mich.

[21] Appl. No.: 818,428

[22] Filed: Jul. 25, 1977

[51] Int. Cl.[2] ..... F02B 33/00

[52] U.S. Cl. ..... 123/119 EC; 123/117 D; 123/32 EB; 60/285

[58] Field of Search ..... 123/119 EC, 32 EE, 32 EH, 123/32 EB, 32 EC, 117 D; 60/285, 276

[56] References Cited

U.S. PATENT DOCUMENTS

| | | | |
|---|---|---|---|
| 3,835,819 | 9/1974 | Anderson, Jr. | 123/117 D |
| 3,895,611 | 6/1975 | Endo et al. | 123/32 EE |
| 3,906,205 | 9/1975 | Yoshida et al. | 123/32 EB |
| 3,927,304 | 12/1975 | Wenteun, Jr. et al. | 123/32 EE |
| 4,073,270 | 2/1978 | Endo | 123/32 EC |

*Primary Examiner*—Charles J. Myhre
*Assistant Examiner*—R. A. Nelli
*Attorney, Agent, or Firm*—Howard N. Conkey

[57] ABSTRACT

A digital closed loop fuel control system for an internal combustion engine having a zirconia sensor which provides a signal changing abruptly between first and second values as the air/fuel ratio varies through a stoichiometric ratio. The output of the zirconia sensor is sampled at constant frequency sampling intervals and an up/down counter is set in one of its counting modes as a function of whether the air/fuel ratio is less than or greater than the stoichiometric ratio. During each sampling interval, a first number of clock pulses from a clock pulse generator are coupled to the up/down counter when the air/fuel ratio is greater than a stoichiometric ratio and a second number of the clock pulses are coupled to the up/down counter when the air/fuel ratio is less than the stoichiometric ratio. The air/fuel ratio of the fuel mixture supplied to the internal combustion engine is varied in accord with the net count in the up/down counter so that the average air/fuel ratio is offset from the stoichiometric air/fuel ratio by a value determined by the difference in the first and second numbers of clock pulses supplied to the up/down counter.

3 Claims, 5 Drawing Figures

DIGITAL CLOSED LOOP FUEL CONTROL SYSTEM

This invention is directed toward a digital closed loop fuel control system for an internal combustion engine.

It is well known that the types and amounts of substances present in engine exhaust is greatly affected by the ratio of air to fuel in the mixture supplied to the engine. Rich mixtures, with excess fuel, tend to produce higher amounts of hydrocarbons and carbon monoxide; whereas lean mixtures, with excess air, tend to produce greater amounts of oxides of nitrogen. It is also well known that exhaust gases can be catalytically treated to reduce the amounts of these undesirable components, the catalytic treatment including oxidation of carbon monoxide and hydrocarbons and reduction of nitrogen oxides.

Both the oxidation and reduction necessary for the minimization of these undesirable exhaust constituents can be achieved with a single catalytic device, provided that the air-fuel mixture supplied to the catalytic converter is maintained within a specified range of stoichiometry, the ratio containing fuel and oxygen in such proportions that, in perfect combustion, both would be completely consumed. When the air/fuel ratio becomes less than stoichiometry, the converter conversion efficiency of nitrogen oxides increases and the conversion efficiency of carbon monoxides and hydrocarbons decreases while when the air/fuel ratio becomes greater than stoichiometry, the opposite conversion efficiency results.

Numerous closed loop fuel control systems are known for controlling the air/fuel ratio of a mixture supplied to an internal combustion engine to a value within the specified range at stoichiometry in response to a sensed gas constituent in the exhaust gases of the internal combustion engine. The gas constituent, which may be oxygen, is representative of the ratio of the air/fuel mixture supplied to the engine. These systems generally employ a sensor, such as a zirconia oxygen sensor, which provides an output signal which shifts between two voltage levels at the stoichiometric air/fuel ratio. This type of sensor functions virtually as a switch, so that it generally provides information indicating whether or not the air/fuel ratio is less than or greater than the stoichiometric air/fuel ratio.

One of the known closed loop fuel control systems includes a switch which is responsive to the oxygen sensor output signal to provide a substantially ideal switch signal shifting between two voltage signals at the stoichiometric air/fuel ratio. This switch signal is supplied to an integral controller which provides an air/fuel ratio control signal which changes at a constant rate in one direction when the air/fuel ratio is greater than the stoichiometric ratio and changes at the same constant rate in the opposite direction when the air/fuel ratio is less than the stoichiometric air/fuel ratio. As a result of delays through the control system, including the transport delay between the air and fuel mixture supply means and the exhaust gas sensor in the exhaust system downstream from the engine, this system oscillates around the stoichiometric air/fuel ratio level with the average value of the air/fuel mixture being stoichiometry. The oscillations do not detrimentally affect the conversion efficiency of the catalytic converter which effectively filters out the oscillations.

While the foregoing system is effective to control the air/fuel ratio at stoichiometry, it may be desirable to provide an air/fuel ratio mixture to the engine that is different from the stoichiometric air/fuel ratio. For example, it may be desirable to operate the engine at an air/fuel ratio within the aforementioned range at stoichiometry but which is greater than the stoichiometric ratio so that the air/fuel mixture is slightly lean during normal engine operation, or to operate the engine at an air/fuel ratio less than stoichiometry where the conversion efficiency of oxides of nitrogen is increased when the engine is under predetermined load at which greater amounts of oxides of nitrogen are produced.

It is the general object of this invention to provide an improved digital closed loop fuel control system for an internal combustion engine which is effective to control the ratio of the air/fuel mixture supplied to the engine to a value offset from a sensed value by a predetermined amount.

It is another object of this invention to provide an improved digital closed loop fuel control system for an internal combustion engine which is responsive to a signal having a value shifting between two states at a predetermined air/fuel ratio and wherein the control system provides an air/fuel ratio offset from the predetermined air/fuel ratio by a specified value.

It is another object of this invention to provide a digital closed loop fuel control system responsive to a signal having an abrupt change between first and second voltage levels at a predetermined air/fuel ratio wherein an up/down counter is repeatedly supplied with respective first or second predetermined numbers of clock pulses for clocking the counter in an up or down direction depending on whether the air/fuel ratio is above or below the predetermined air/fuel ratio to provide a control signal for controlling the air/fuel mixture so that the air/fuel mixture has an average value offset from the predetermined air/fuel ratio.

These and other objects of this invention are accomplished by sampling the output of an oxygen sensor at a constant sampling frequency. When the output of the oxygen sensor represents an air/fuel ratio greater than the stoichiometric ratio, an up/down counter is set in one of its counting modes and when the air/fuel ratio is less than a stoichiometric air/fuel ratio, the up/down counter is set in the other one of its counting modes. A first predetermined number of clock pulses is then counted by the up/down counter during each sampling interval when the air/fuel ratio is greater than the stoichiometric ratio and a second predetermined number of clock pulses is then counted by the up/down counter during each sampling interval when the air/fuel ratio is less than the stoichiometric air/fuel ratio. The net count in the counter is maintained after the first or second predetermined number of clock pulses are counted until the next sampling interval. The air/fuel ratio is controlled in accordance with the net count in the up/down counter. The average air/fuel ratio of the mixture supplied to the internal combustion engine is equal to a value which is offset from the stoichiometric air/fuel ratio by an amount determined by the difference of the first and second predetermined numbers of clock pulses.

The invention may be best understood by reference to the following description of a preferred embodiment and the drawings in which.

Figure 1:
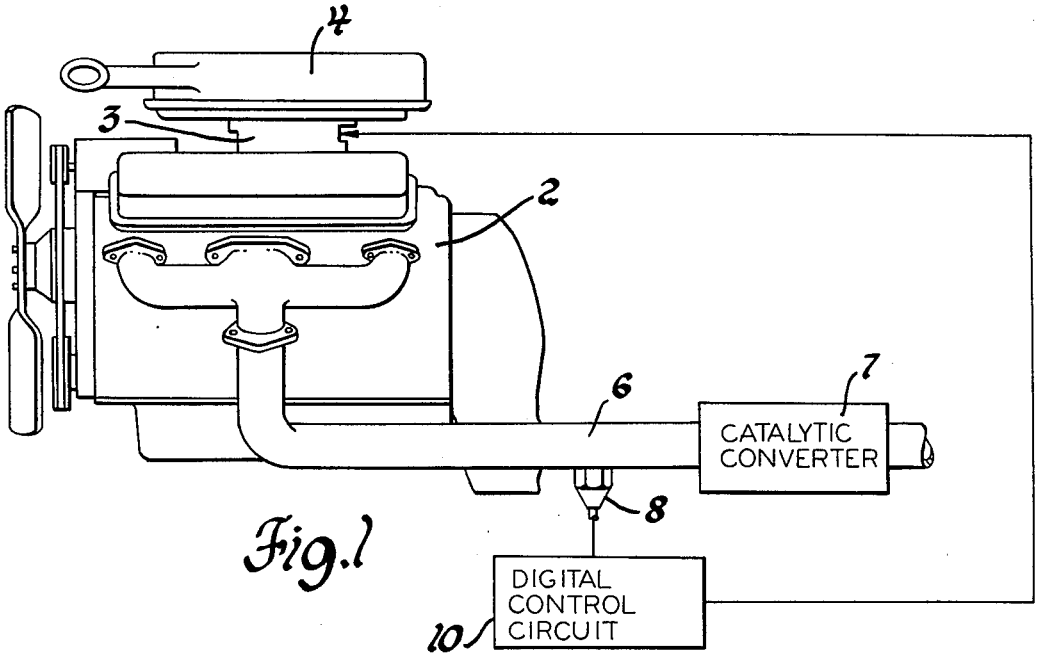
FIG. 1 shows the environment of the digital control system of the invention.

Referring to FIG. 1, an internal combustion engine 2 is supplied with a mixture of fuel and air to appropriate conventional air/fuel supply means. In this embodiment, the supply means includes a carburetor 3 and an air cleaner 4, although it is understood that the supply means could employ fuel injection or other means.

The engine 2 exhausts its spent gases through an exhaust conduit 6 which includes a catalytic converter 7. The catalytic converter 7 is a device of the type in which exhaust gases flowing therethrough are exposed to a catalytic substance such as platinum or palladium which, given the proper air/fuel ratio in the exhaust gases, will promote simultaneous oxidation of carbon monoxide and hydrocarbons and reduction of oxides of nitrogen. The exhaust conduit 6 is provided with an oxygen sensor 8 upstream from the catalytic converter which is preferably of the zirconia electrolyte type which, when exposed to engine exhaust gases at high temperatures, generates an output voltage which changes abruptly as the air/fuel ratio of the exhaust gases passes through the stoichiometric air/fuel ratio value. Such sensors are well known in the art, a typical example being that shown in the U.S. Pat. No. 3,844,920 to Burgett et al, dated Oct. 29, 1974.

Figure 2:
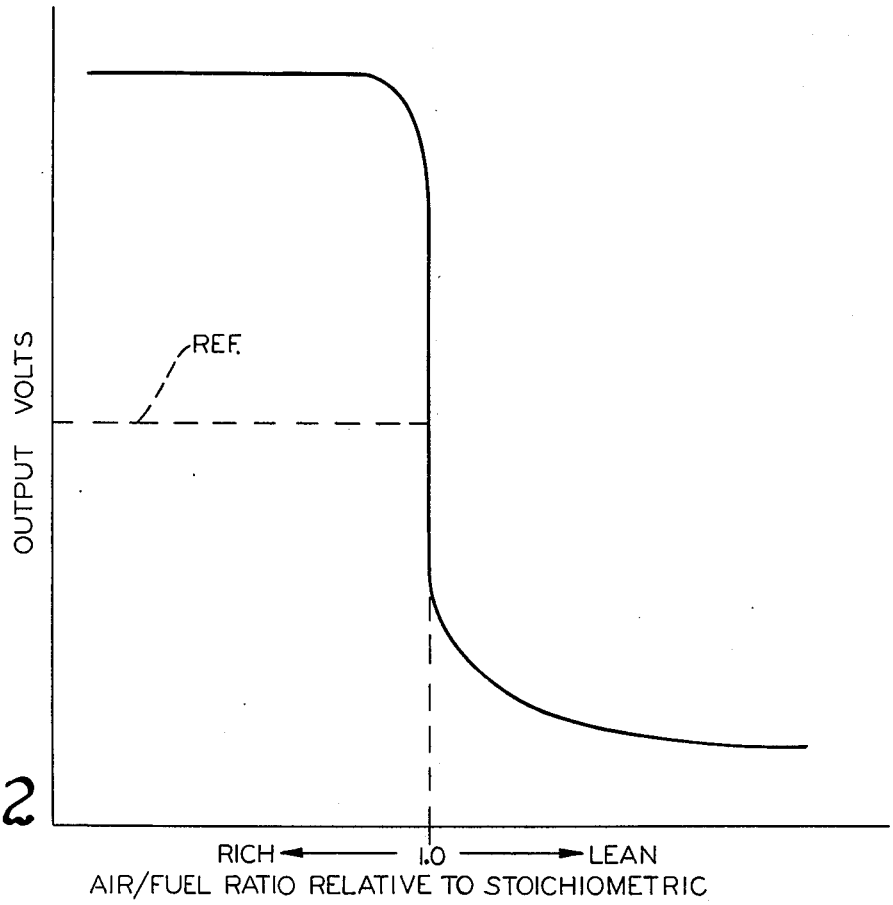
FIG. 2 is a graph illustrating a typical output voltage as a function of the air/fuel ratio of an air/fuel ratio sensor.

FIG. 2 illustrates the output voltage of the oxygen sensor 8 as a function of the air/fuel ratio. It can be seen that the voltage output of the oxygen sensor achieves its highest output level with rich air/fuel mixtures and its lowest level when the sensor is exposed to lean air/fuel mixtures. Further, it can be seen that the output voltage from the oxygen sensor exhibits an abrupt change between the high and low voltage values as the air/fuel ratio mixture passes through the stoichiometric air/fuel ratio. It is this characteristic of the oxygen sensor which renders it primarily applicable to the controlling of the air/fuel mixture supplied to the engine 2 to a stoichiometric air/fuel ratio value. However, it may be desirable to operate the engine 2 with air/fuel ratios varying from the stoichiometric air/fuel ratio. For example, it may be desirable to operate the engine 2 at an air/fuel ratio within the maximum conversion efficiency range for simultaneous conversion of carbon monoxides, hydrocarbons, and nitrogen oxides but which is greater than stoichiometry so that the air/fuel ratio is slightly lean during normal engine operation. Further, during heavy vehicle loading conditions where greater amounts of nitrogen oxides are formulated by the engine combustion process, it may be desired to shift the air/fuel ratio to a value richer than stoichiometry so as to provide an operating point for the catalytic converter 7 at which it is more efficient in reducing the oxides of nitrogen. The digital control circuit 10 of this invention, the preferred embodiment of which is set forth in FIGS. 3 and 4, is responsive to the output of the oxygen sensor 8 to control the air/fuel ratio of the mixture supplied by the carburetor 3 to the desired value offset from the stoichiometric air/fuel ratio.

Figure 3:
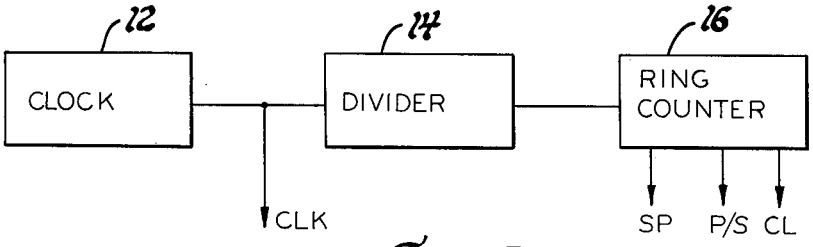
FIG. 3 is a block diagram of the timing pulse generator of the preferred embodiment of the invention.
Figure 4:
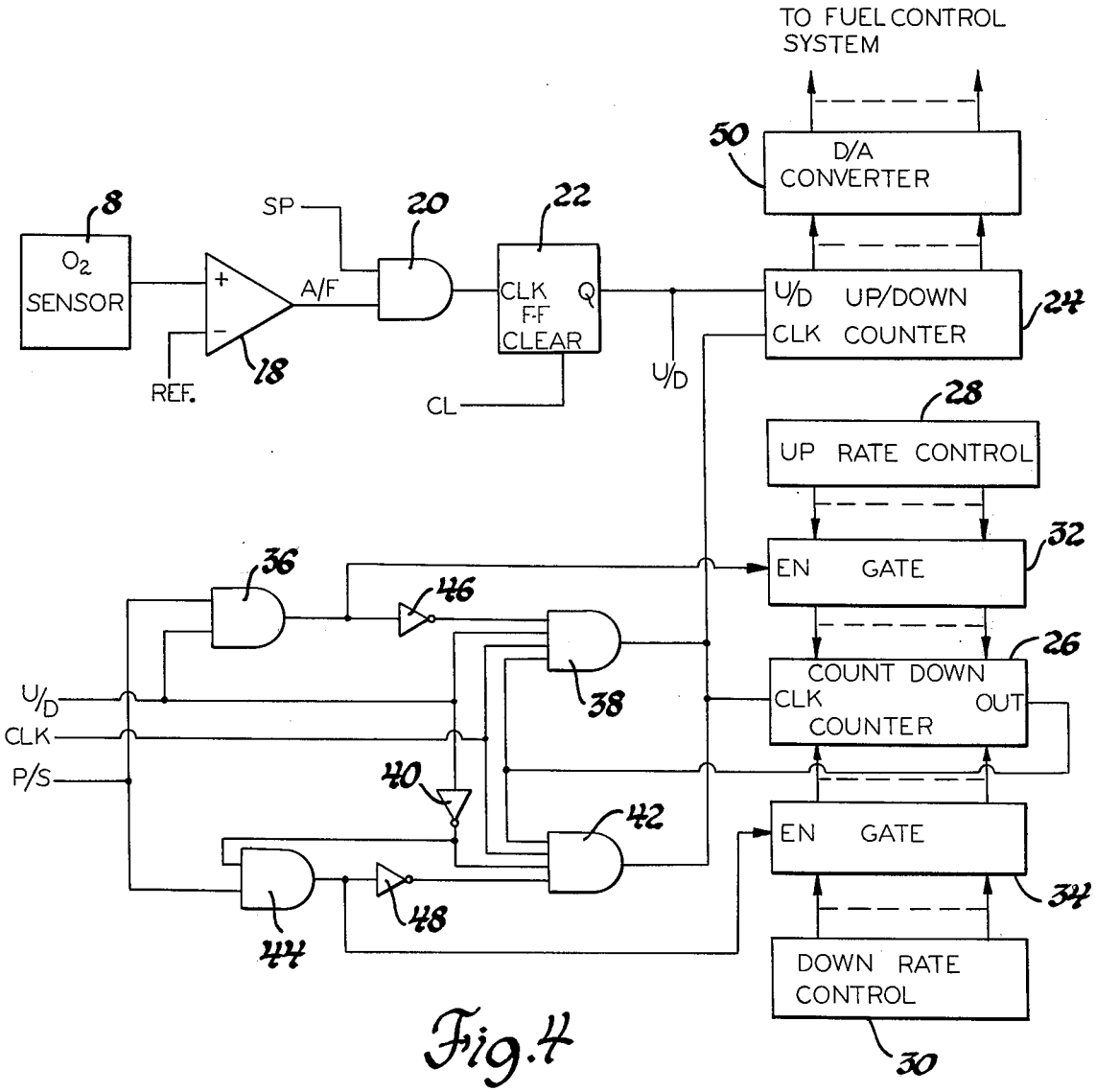
FIG. 4 is a digital logic diagram illustrating the preferred embodiment of the invention.
Figure 5:
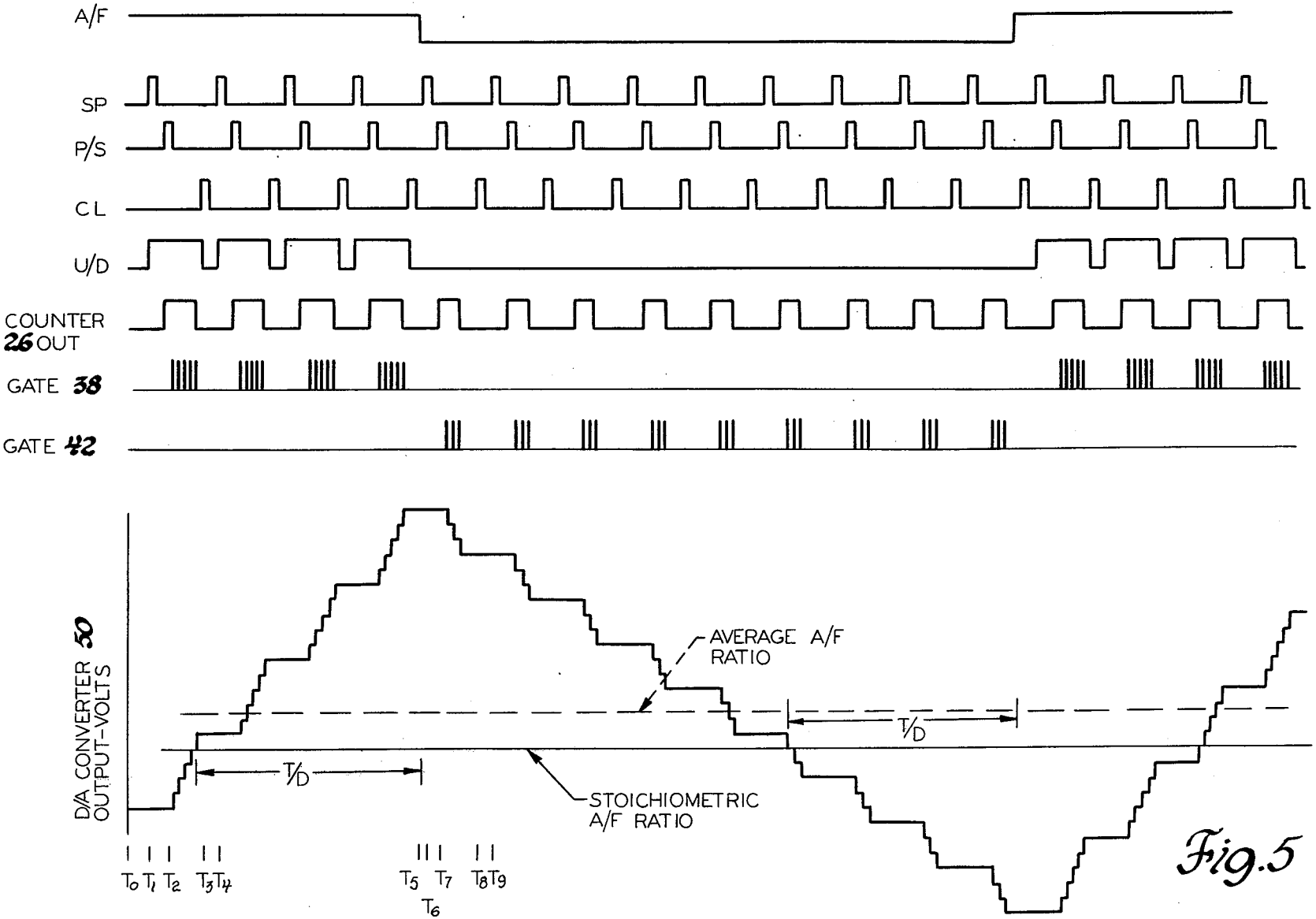
FIG. 5 is a timing and voltage diagram illustrating various output signals of the apparatus of FIG. 4.

Referring to FIGS. 3 and 4, a high frequency clock generator 12 supplies clock pulses CLK at a constant frequency to a frequency divider 14. The output pulses from the divider 14 are coupled to a ring counter 16 which provides sequential logic pulses for controlling the sequence of operation of the system of FIG. 4. The sequentially generated pulses are comprised of a sampling pulse SP, a preset pulse P/S and a clear pulse CL which are repeatedly generated in sequence. These pulses and their time relationship are illustrated in FIG. 5. The time period between sampling pulses SP constitutes a sampling interval. The counter 16 may take the form of a conventional binary counter and binary-coded-decimal to decimal decoder which may, if required, have its outputs inverted to achieve the digital logic 1 pulses.

Referring to FIG. 4, the oxygen sensor 8, which may be a zirconia sensor providing an output signal such as illustrated in FIG. 2, supplies its output voltage to the positive input of a comparator switch 18. A reference voltage having a value intermediate the upper and lower voltage levels of the output of the oxygen sensor 8 as illustrated in FIG. 2 is applied to the negative input of the comparator switch. When the air/fuel ratio of the mixture supplied to the engine 2 is greater than stoichiometry, the output of the oxygen sensor 8 is at a voltage level greater than the reference voltage so that the output of the comparator switch 18, hereinafter referred to as the air/fuel ratio logic signal A/F, is a positive voltage level which constitutes a digital logic 1 level. When the air/fuel ratio is greater than the stoichiometric air/fuel ratio, the output of the oxygen sensor 8 is at a voltage level below the reference voltage level so that the output of the comparator switch 18 is at substantially ground potential which constitutes a digital logic 0 level.

The air/fuel ratio logic signal A/F from the comparator switch 18 is supplied to one input of an AND gate 20 having a second input to which the sampling pulse SP is applied. The AND gate 20 functions with the sampling pulse SP to sample the sensed air/fuel ratio represented by the air/fuel ratio logic signal A/F at the beginning of each sampling interval. If the output of the switch 18 is a logic 1 level representing a sensed air/fuel ratio less than stoichiometry, the output of the AND gate 20 will be a logic 1 level for the duration of the sampling pulse SP and if the output of the switch 18 is a logic 0 level representing a sensed air/fuel ratio greater than stoichiometry, the output of the AND gate 20 remains a constant logic 0 level.

The output of the AND gate 20 is coupled to the clock input of a flip-flop 22 which has a clear input to which the clear pulse CL is coupled. The flip-flop 22 is clocked upon a logic 0 to logic 1 level transition at its clock input. When so clocked, the Q output of the flip-flops shifts logic states. The clear pulse CL is effective to set the Q output of the flip-flop to a logic 0 state.

The output of the flip-flop 22 comprises an up/down logic signal U/D which is coupled to the up/down control input of a conventional up/down counter 24. The up/down counter 24 is set in a count up state when the Q output of the flip-flop 22 is a logic 1 and is set to a count down state when the Q output of the flip-flop 22 is a logic 0.

The flip-flop 22 responds to the output of the AND gate 20 and the clear pulse CL to provide the logic signal U/D as follows beginning after the flip-flop 22 has been cleared by a clear pulse CL: Upon the occurrence of the sampling pulse SP, the AND gate 20 supplies a logic 1 pulse if the air/fuel ratio logic signal output A/F of the comparator switch 18 is a logic 1 representing a sensed air/fuel ratio less than stoichiometry. This logic 1 pulse clocks the flip-flop 22 whose Q output shifts to a logic 1 level which sets the up/down counter in its count up state. If the air/fuel ratio logic signal A/F is a logic 0 representing a sensed air/fuel ratio greater than stoichiometry, the output of the AND gate 20 remains a constant digital logic 0 upon the occurrence of the sampling pulse SP so that the Q output of the flip-flop remains at a logic 0 level which sets the up/down counter in its count down state. The resulting state of the up/down signal U/D at the Q output of the flip-flop 22 during the time period between the sampling pulse SP and the subsequent clear pulse CL represents the relationship of the air/fuel ratio sensed by the sensor 8 relative to the stoichiometric air/fuel ratio. In this respect, the up/down logic signal U/D is a logic 1 level between the sampling pulse SP and the clear pulse CL when the sensed air/fuel ratio is less than stoichiometry and is a logic 0 level between the sampling pulse SP and the clear pulse CL when the air/fuel ratio is greater than the stoichiometric air/fuel ratio. As indicated, the up/down signal U/D controls the counting stage of the up/down counter 24 which is set in its count up mode when the up/down signal is a logic 1 representing a rich air/fuel ratio and is set in its count down mode when the up/down signal represents a lean air/fuel ratio.

A presettable count down counter 26 is provided which is selectively presettable to one of two predetermined binary numbers stored respectively in an up rate control circuit 28 and a down rate control circuit 30. The binary number contained in the up rate control 28 is coupled to respective inputs of a gate circuit 32 whose outputs are coupled to respective preset inputs in the stages in the count down counter 26. In like manner, the binary output of the down rate control 30 is coupled to respective inputs of a gate circuit 34 whose outputs are coupled to respective preset inputs of the stages of the count down counter 26.

The gates 32 and 34 each have an enable input wherein a logic 1 signal applied to the enable input opens the gate to couple the binary number in the up rate control 28 and the down rate control 30 to the preset inputs of the count down counter 26 which is then preset to the respective binary number. The count down counter 26 counts down in response to clock pulses supplied to a clock input thereof and further provides an output which is a continuous digital logic 0 when all of the stages in the count down counter 26 are logic 0 and which is a digital logic 1 when any one of the stages in the count down counter 26 has an output which is a digital logic 1. In this respect, the output of the count down counter 26 is a logic 1 level whenever the binary number in the counter represents a number other than zero, and is a logic 0 level when the binary number in the count down counter 26 represents zero. The output signal from the count down counter 26 may be provided, for example, by coupling the outputs of its respective stages to inputs of an internal OR gate whose output provides the desired logic level.

The up/down logic signal U/D is coupled to one input of an AND gate 36, one input of an AND gate 38 and to the input of an inverter 40. The clock pulses CLK are coupled to respective inputs of the AND gate 38 and an AND gate 42. The preset pulse P/S is coupled to a second input of the AND gate 36 and to an input of an AND gate 44. The output of the AND gate 36 is coupled to the enable input of the gate 32 and to the input of an inverter 46 whose output is coupled to a respective input of the AND gate 38. The output of the inverter 40 is coupled to a second input of the AND gate 44 and to a respective input of the AND gate 42. The output of the AND gate 44 is coupled to the enable input of the gate 34 and to the input of an inverter 48 whose output is coupled to a respective input of the AND gate 42. The output from the count down counter 26 is coupled to respective inputs of the AND gates 38 and 42 whose outputs are both coupled to the clock input of the count down counter 26 and to the clock input of the up/down counter 24.

When the up/down logic signal U/D is at a logic 1 level representing a sampled air/fuel ratio less than stoichiometry, the resulting logic 0 level at the output from the inverter 40 functions to maintain the output of the AND gate 42 at a logic 0 level and enables the AND gate 38 to provide a logic 1 level output when its remaining inputs are at a logic 1 level. Further, the AND gate 36 is enabled to provide a logic 1 pulse, when the preset pulse P/S is generated, to enable the gate 32 to couple the memorized up rate control number from the up rate control circuit 28 to the preset inputs of the count down counter 26 which is preset to the up rate control number. When the count down counter 26 is preset, its output is at a logic 1 level so that upon termination of the preset pulse P/S and resulting logic 1 level output of the inverter 46, the AND gate 38 is enabled by the clock pulses to supply clock pulses to the clock inputs of each of the counters 24 and 26. The count down counter 26 is counted down by the clock pulses until it is counted to the numeral zero at which time its output shifts to a logic 0 level to disable the AND gate 38. Consequently, the number of clock pulses supplied by the AND gate 38 is equal to the memorized number in the up rate control circuit 28 which was preset into the counter 26. The up/down counter, which is set in its count up mode by the logic 1 level of the up/down logic signal U/D, is also counted in an up direction by the same number of clock pulses.

When the up/down logic signal U/D is at a logic 0 level subsequent to a sampling pulse SP, representing a sampled air fuel ratio greater than stoichiometry, the output of the AND gate 38 is maintained at a logic 0 level and the resulting logic 1 level at the output of the inverter 40 enables the AND gate 42 to provide a logic 1 level output when its remaining inputs are at a logic 1 level. Further, the AND gate 44 is enabled to provide a logic 1 pulse when the preset pulse P/S is generated to enable the gate 34 to couple the memorized down rate control number from the down rate control circuit 30 to the preset inputs of the count down counter 26 which is preset to the down rate control number. When the count down counter is preset, its output is at a logic 1 level so that upon termination of the preset pulse P/S and resulting logic 1 level output of the inverter 48, the AND gate 42 is enabled by the clock pulses to supply clock pulses to the clock inputs of each of the counters 24 and 26. The count down counter 26 is counted down by the clock pulses until it is counted to the numeral zero at which time its output shifts to a logic 0 level to disable the AND gate 42. Consequently, the number of clock pulses supplied by the AND gate 42 is equal to the memorized number in the down rate control circuit 30 which was preset into the counter 26. The up/down counter, which is set in its count down mode by the logic 0 level of the up/down logic signal U/D, is also counted in a down direction by the same numbers of clock pulses.

The circuit described functions as an integrator whose output is represented by the net count in the up/down counter 24 and which has an integrating time constant, when integrating in an up direction in response to a sampled air/fuel ratio less than stoichiometry, determined by the memorized number in the up rate control circuit 28 and which has an integrating time constant, when integrating in a down direction in response to a sampled air/fuel ratio greater than stoichiometry, determined by the memorized number in the down rate control circuit 30. As will be described, the resulting air/fuel ratio of the mixture supplied to the engine 2 is a value offset from a stoichiometric air/fuel ratio by an amount determined by the two memorized numbers in the up and down rate control circuits 28 and 30.

The net count in the up/down counter 24, which is in binary form, is coupled to a digital to analog converter 50 whose output voltage has a magnitude determined by the net count output of the up/down counter 24. This voltage is coupled either directly or through an inverting amplified, as required, to a control device in the throttle 3 for controlling the air/fuel ratio such that for an increasing net count in the up/down counter 24, the air/fuel ratio is increased and for a decreasing net count in the up/down counter 24, the air/fuel ratio is decreased. For example, the controller described in U.S. Pat. No. 3,939,654, Creps, issued Feb. 24, 1976, and assigned to the assignee of this invention may be employed with an inverting amplifier at the output of the D/A converter 50.

The operation of the circuit of FIG. 4 will be described with reference to the timing and voltage diagrams of FIG. 5. The initial condition at time $T_o$ for purposes of description of the operation are assumed as follows: the air/fuel ratio supplied by the carburetor 3 is less than stoichiometry representing a rich air/fuel mixture so that the output of the oxygen sensor 8 is greater than the reference voltage supplied to the switch 18 resulting in the air/fuel ratio logic signal A/F being a logic 1 level. Further, it is assumed that the Q output of the flip-flop 22 is at a logic 0 level and the output of the count down counter 26 is a digital logic 0 so that the outputs of the AND gates 38 and 42 are each at a logic 0 level.

At time $T_1$, a sampling pulse SP is generated to sample the output of the oxygen sensor 8 as represented by the air/fuel ratio signal A/F. During the period of the sampling pulse, both inputs to the AND gate 20 are logic 1 levels so that a logic 1 pulse is provided at its output which clocks the flip-flop 22 to shift the up/-down signal U/D to a digital logic 1 representing a sampled rich air/fuel ratio. The up/down counter 24 is set in its count up mode by the logic 1 level of the up/-down signal U/D.

At time $T_2$, the preset signal P/S is generated which enables the AND gate 36 to provide a logic 1 pulse to enable the gate 32 to couple the memorized up rate control number in the up rate control circuit 28 to the preset inputs of the count down counter 26 which is set to the memorized up rate control number. The output of the count down counter 26 therefore shifts to a digital logic 1. Upon termination of the preset pulse, the output of the inverter 46 shifts to a digital logic 1 so that all of the inputs of the AND gate 38 are at a logic 1 level during each clock pulse CP. Consequently, the output of the AND gate 38 is a series of clock pulses CP which are coupled to the clock inputs of the down counter 26 and the up/down counter 24. Each of the counters 24 and 26 are clocked in synchronism until the count down counter 26 is counted down to 0 at which time its output shifts to a digital logic 0 to disable the AND gate 38. In this manner, the up/down counter 24 is counted in an up direction by a number equal to the number stored in the up rate control circuit 28. The resulting voltage output of the digital to analog converter is illustrated in FIG. 5 wherein the voltage is increased in a stepped fashion with the number of steps corresponding to the number of clock pulses counted by the up/down counter 24 in the up direction. For purposes of illustration, it will be assumed that the up rate control 28 has the number five stored therein so that five clock pulses were supplied to the up/down counter 24 following the preset pulse at time $T_2$ as illustrated in FIG. 5.

At time $T_3$, the clear pulse CL is generated which resets the flip-flop 22 so that the circuit is in condition to again sample the output of the oxygen sensor 8 at time $T_4$ at which time the sampling pulse SP is again generated. This sequence is continually repeated with the net count output of the up/down counter 24 being increased in groups of five counts during each sampling interval between sampling pulses. As illustrated in FIG. 5, during each sampling interval and after the fifth count, the net count in the up/down counter 24 is maintained until the next sampling interval.

During the counting interval beginning at time $T_2$, the voltage output of the digital to analog converter achieves a level which results in the air/fuel ratio output of the carburetor 3 being equal to the stoichiometric air/fuel ratio. This voltage level for the particular engine operating conditions at which stoichiometric air/fuel mixture is achieved is represented by the solid line in the voltage waveform of FIG. 5. However, due to delays including the transport delay time between the adjustment of the carburetor 3 and the sensing of the resulting adjusted value of the air/fuel ratio by the oxygen sensor 8, the transition of the air/fuel ratio through the stoichiometry is not sensed until time $T_5$ which occurs after the lapse of the delay time $T_D$ after the air/fuel ratio mixture output of the carburetor passed through the stoichiometric value. At this time, the air/fuel ratio signal A/F from the comparator switch 18 shifts to a digital logic 0 representing a sensed air/fuel ratio greater than stoichiometry.

Upon the occurrence of the next sampling interval beginning with a sampling pulse SP at time $T_6$, the output of the flip-flop 22 remains a digital logic 0 so that the up/down counter 24 remains in a count down mode.

At time $T_7$, a preset pulse P/S is generated which enables the AND gate 44 to provide a logic 1 pulse to enable the gate 34 to couple the memorized down rate control number in the down rate control circuit 30 to the preset inputs of the count down counter 26 which is set to memorized down rate control number. The output of the count down counter therefore shifts to a digital logic 1 level. For purposes of illustration of the invention, it is assumed that the number three is stored in the down rate control circuit 30 and is preset in the count down counter 26.

Upon the termination of the preset pulse P/S, the output of the inverter 48 shifts to a logic 1 so that all of the inputs of the AND gate 42 are a logic 1 level during each clock pulse CP. Consequently, the output of the AND gate 42 is a series of clock pulses CP which are coupled to the clock inputs of the up/down counter 24 and the count down counter 26. The up/down counter 24 and the count down counter 26 are simultaneously clocked by the clock pulse CP until the count down counter 26 is counted down to zero at which time its output shifts to a digital logic 0 to disable the AND gate 42 which is prevented from providing further clock pulses CP. In this manner, the up/down counter 24 is counted down by a number equal to the binary number preset into the count down counter 26 from the down rate control circuit 30 which for purposes of illustration is assumed to be three. As seen in FIG. 5, the voltage waveform is stepped three levels in response to the counting down of the net count in the up/down counter 24 beginning at time $T_7$. Thereafter, at time $T_8$ and $T_9$ the clear pulse CL and a sampling pulse are again generated.

As long as the output of the oxygen sensor 8 represents an air/fuel ratio greater than stoichiometry, the up/down counter 24 is counted down by the number of pulses determined by the number stored in the down rate control circuit 30 in each sampling interval with the net count being maintained for the duration of a sampling interval and until the initiation of another sampling interval. The process is repeated until the delay time $T_D$ after the output voltage from the digital to analog converter again becomes equal to the value providing a stoichiometric air/fuel ratio output of the carburetor 3. After the transport delay time $T_D$, the output of the oxygen sensor 8 again shifts to the high voltage output in response to the air/fuel ratio decreasing to a value less than the stoichiometric air/fuel ratio resulting in the output of the comparator switch 18 shifting to a logic 1 level. Thereafter, the up/down counter 24 is counted up by the predetermined number of clock pulses determined by the up rate control circuit 28 as previously described.

The foregoing cycles of operation are continually repeated with the air/fuel ratio oscillating about the stoichiometric air/fuel ratio as sensed by the oxygen sensor 8. However, since the number of clock pulses coupled to the up/down counter 24 during each sampling interval is different when the air/fuel ratio is less than stoichiometric than when the air/fuel ratio is greater than stoichiometric, the average air/fuel ratio is shifted or offset from the stoichiometric air/fuel ratio as sensed by the oxygen sensor 8 by an amount which is determined by the difference between the predetermined numbers stored within the up rate control circuit 28 and the down rate control circuit 30. In the embodiment described, the average air/fuel ratio resulting from the stored numbers five and three is represented by the dotted line in the voltage signal waveform of FIG. 5 wherein the average air/fuel ratio is greater than stoichiometry. By controlling the difference between the numbers that are preset into the count down counter 26, the air/fuel ratio may be varied to any desired value. For example, by reversing the numbers in the up and down rate control circuits 28 and 30, an air/fuel ratio less than stoichiometry is achieved and by making both numbers the same, an average air/fuel ratio equal to stoichiometry is achieved.

In summary, the up/down counter 24 is controlled so that it functions as an integrator which has a first time constant producing a certain predetermined average rate of increase when the air/fuel ratio is less than stoichiometry determined by the binary number stored in the up rate control 28 and has a second time constant controlling the rate of change in the counter when the output of the oxygen sensor represents an air/fuel ratio greater than stoichiometry determined by the binary number stored within the down rate control circuit 30. By predetermined selection or by changing the stored binary numbers dynamically as a function of certain vehicle parameters, the average air/fuel ratio or offset from the air/fuel ratio at which the sensor provides the voltage shift may be controlled. This is achieved by a digital circuit which does not require the provision of a variable frequency source but employs constant frequency signals in a substantially simple and inexpensive control circuit.

The preferred embodiment of the invention for the purpose of illustrating the principles thereof is not to be considered as limiting or restricting the invention since many modifications may be made by the exercise of skill in the art without departing from the scope of the invention.

We claim:

1. A closed loop system for controlling the ratio of the air/fuel mixture supplied to an internal combustion engine, the system comprising:

means responsive to the content of the exhaust gas output of the internal combustion engine effective to generate an air/fuel ratio signal changing abruptly between first and second voltage values in accord with the relationship of the air/fuel ratio relative to a stoichiometric ratio;

an up/down digital counter having selectable up and down counting modes;

means effective to generate clock pulses at a substantially constant frequency;

means responsive to the voltage values of the air/fuel ratio signal effective at sampling intervals having a predetermined time spacing to (1) enable the up/-down counter to count a predetermined first number of clock pulses in one of its counting modes and maintain the net count to the next sampling interval when the air/fuel ratio signal is at one of its voltage values and (2) enable the up/down counter to count a predetermined second number of clock pulses in the other one of its counting modes and maintain the net count to the next sampling interval when the air/fuel ratio signal is at the other one of its voltage values; and means effective to vary the air/fuel ratio in accord with the net count in the up/down counter, the air/fuel ratio being controlled by the last mentioned means to a value offset from the stoichiometric value by an amount determined by the first and second numbers of clock pulses.

2. A closed loop system for controlling the ratio of the air/fuel mixture supplied to an internal combustion engine, the system comprising:

means responsive to the content of the exhaust gas output of the internal combustion engine effective to generate an air/fuel ratio signal changing abruptly between first and second voltage values in accord with the relationship of the air/fuel ratio relative to a stoichiometric ratio;

control means effective to control the ratio of the air/fuel mixture in accord with an applied signal; and means connecting the first mentioned means and the control means in a closed loop system effective to control the air/fuel ratio, the last mentioned means including an up/down digital counter having selectable up and down counting modes effective to count clock pulses coupled thereto and cause a progressively increasing value of the air/fuel ratio in accord with the net count when counting in one of the counting modes and a progressively decreasing value of the air/fuel ratio in accord with the net count when counting in the other one of the counting modes, means effective to generate clock pulses at a substantially constant frequency, and means effective at successive substantially uniform time periods to select one of the counting modes of the counter and couple the clock pulses to the counter until a first number of clock pulses is counted when the air/fuel ratio signal is at the first voltage value and to select the other one of the counting modes of the counter and couple the clock pulses to the counter until a second number of clock pulses is counted when the air/fuel ratio signal is at the second voltage value so that the control means controls the air/fuel ratio to a value offset from the stoichiometric value by an amount determined by the first and second numbers of clock pulses.

3. An apparatus for controlling the ratio of the air/fuel mixture supplied to an internal combustion engine to average value offset from the stoichiometric value by a specified amount, the apparatus comprising:

an air/fuel ratio mixture control means;

an exhaust gas sensor means responsive to the exhaust gas output of the internal combustion engine effective to generate a signal that rapidly changes at substantially the stoichiometric air/fuel ratio to indicate the air/fuel ratio of the air/fuel mixture supplied to the engine;

means responsive to the signal from the exhaust gas sensor means effective to generate a two-state signal having a first state when the air/fuel ratio is greater than the stoichiometric value and a second state when the air/fuel ratio is less than the stoichiometric value;

an up/down digital counter having selectable up and down counting modes effective to add or subtract clock pulses coupled thereto to a count therein in accordance with the counting mode;

a second digital counter effective to count clock pulses supplied thereto;

means effective to generate clock pulses at a substantially constant frequency;

means effective in repeated and timed sequence to (A) set the up/down counter in one of its counting modes when the two-state signal is in its first state and in the remaining one of its counting modes when the two-state signal is in its second state, (B) preset a first reference count in the second counter when the two-state signal is in its first state and a second reference count in the second counter when the two-state signal is in its second state, and (C) couple the clock pulses to the up/down counter and the second counter until the second counter is counted to a predetermined number, the sequence being repeated at a constant frequency, the average rate of change in the count of the up/down counter over the period of the repeated and timed sequence being a first value determined by the value of the first reference count when the two-state signal is in its first state representing an air/fuel ratio greater than stoichiometric value and a second value determined by the value of the second reference count when the two-state signal is in its second state representing an air/fuel less than stoichiometric value; and means effective to set the air/fuel ratio mixture control means in accordance with the count in the up/down counter, the air/fuel ratio of the air/fuel mixture supplied to the engine being decreased at one average rate with a changing count in the up/down counter when the two-state signal is in the second state representing an air/fuel ratio less than the stoichiometric value and being increased at another average rate with changing counts in the up/down counter when the two-state signal is in the first state representing the air/fuel ratio being greater than the stoichiometric value so as to provide an average air/fuel ratio offset from the stoichiometric value, the first and second reference counts varying from one another by an amount related to the desired air/fuel ratio offset.

* * * * *